US008205888B2

(12) United States Patent
Deatherage, Jr.

(10) Patent No.: US 8,205,888 B2
(45) Date of Patent: Jun. 26, 2012

(54) MARKSMANSHIP TARGET APPARATUS

(76) Inventor: Robert Henry Deatherage, Jr., Saint Joseph, MO (US)

( * ) Notice: Subject to any disclaimer, the term of this patent is extended or adjusted under 35 U.S.C. 154(b) by 0 days.

(21) Appl. No.: 12/400,673

(22) Filed: Mar. 9, 2009

(65) Prior Publication Data

US 2010/0225064 A1 Sep. 9, 2010

(51) Int. Cl.
*F41J 1/00* (2006.01)
*F41G 3/26* (2006.01)

(52) U.S. Cl. ..... 273/405; 273/407; 273/384; 434/19

(58) Field of Classification Search ..... 273/371–377, 273/355, 356, 384, 403–410; 434/19–21
See application file for complete search history.

(56) References Cited

U.S. PATENT DOCUMENTS 1,035,811 A * 8/1912 Paterson ..... 273/358
2,404,653 A * 7/1946 Plebanek ..... 463/50
4,934,937 A * 6/1990 Judd ..... 434/21
5,092,607 A * 3/1992 Ramsay et al. ..... 273/372
5,320,358 A * 6/1994 Jones ..... 273/371
5,375,847 A * 12/1994 Fromm et al. ..... 463/5
5,599,187 A * 2/1997 Mesiano ..... 434/19
5,676,548 A * 10/1997 McAlpin et al. ..... 434/19
5,980,254 A * 11/1999 Muehle et al. ..... 434/11
2007/0045965 A1* 3/2007 Bateman et al. ..... 273/407

* cited by examiner

*Primary Examiner* — Mark Graham

(57) ABSTRACT

A target training apparatus that fires projectiles at a trainee to simulate combat situations until the trainee strikes predetermined locations on target mounts made of standard paper or cardboard, wherein the predetermined locations correspond with deactivation wands that deactivate the apparatus and ceases firing from the target training apparatus. The apparatus comprises a base, a target column, deactivation wands, a firing column, paintball guns, and a plurality of target elements. The apparatus includes slots to hold compressed air bottles for propelling the paintballs and utility housing for providing power to the trigger system which controls the firing of the two paintball guns. The trigger system rotates a trigger lever in cyclic revolutions which causes the trigger to pull and fire rounds at the trainee.

10 Claims, 5 Drawing Sheets

MARKSMANSHIP TARGET APPARATUS

CROSS-REFERENCE TO RELATED APPLICATION

None

FEDERALLY SPONSORED RESEARCH

Not Applicable

SEQUENCE LISTING OR PROGRAM

Not Applicable

STATEMENT REGARDING COPYRIGHTED MATERIAL

Portions of the disclosure of this patent document contain material that is subject to copyright protection. The copyright owner has no objection to the facsimile reproduction by anyone of the patent document or the patent disclosure as it appears in the Patent and Trademark Office file or records, but otherwise reserves all copyright rights whatsoever.

BACKGROUND

The present invention generally relates to target training apparatuses, and particularly to an apparatus which simulates a combat situation involving return gunfire.

Many target training apparatuses are well known in the art. For example U.S. Pat. No. 5,676,548 to McAlpin et al discloses an apparatus for target practice using a target plate, indicators such as lights for indicating that a practice round has begun, a target sensor, such as a vibration sensor switch, for detecting when the target plate has been struck by a bullet, and a mechanism for firing a projectile at a shooter if the shooter does not hit the target plate within the allotted time.

However, McAlpin does not simulate actual combat conditions nor train for advanced marksmanship. This is because McAlpin conditions a shooter to simply hit the target, regardless of whether the point of contact is vital in disabling the target so that it does not fire back. For example, shooting the target in the leg, arm, foot, or shoulder will seldom stop the target from firing back.

It is therefore an object of the present invention, to develop advanced marksmanship with firearms by providing a combat training apparatus that shoots at trainees until a trainee successfully strikes the target at predetermined positions accurately and precisely and therefore mimicking a real gun fire scenario.

SUMMARY

The present invention comprises a target training apparatus that fires projectiles at a trainee. The apparatus comprises a base having a top surface and bottom surface, wherein the bottom surface features extended legs and the top surface supports a target column and firing column in a substantially upright position. The base further comprises a utility box disposed on the top surface, wherein the utility box houses electronic wires, a power supply, and compressed air.

A pair of paintball guns are disposed in the firing columns, wherein the firing columns are mounted on the top surface of the base. A triggering mechanism engages the paintball guns to shoot at a trainee until the trainee strikes at least one predetermined location on commercially available target signs disposed on a target column, wherein the target sign can be made of standard paper, cardboard, or other material penetrable by a paintball gun pellet, standard training munitions, or standard live munitions.

The utility box houses the target wand electronics, wherein deactivation wands are disposed on the target column behind the target signs. When a deactivation wand is struck by a bullet or pellet, the target wand electronics cuts the power supply to the triggering mechanism and causes the paintball guns to cease fire.

DETAILED DESCRIPTION

Figure 1:
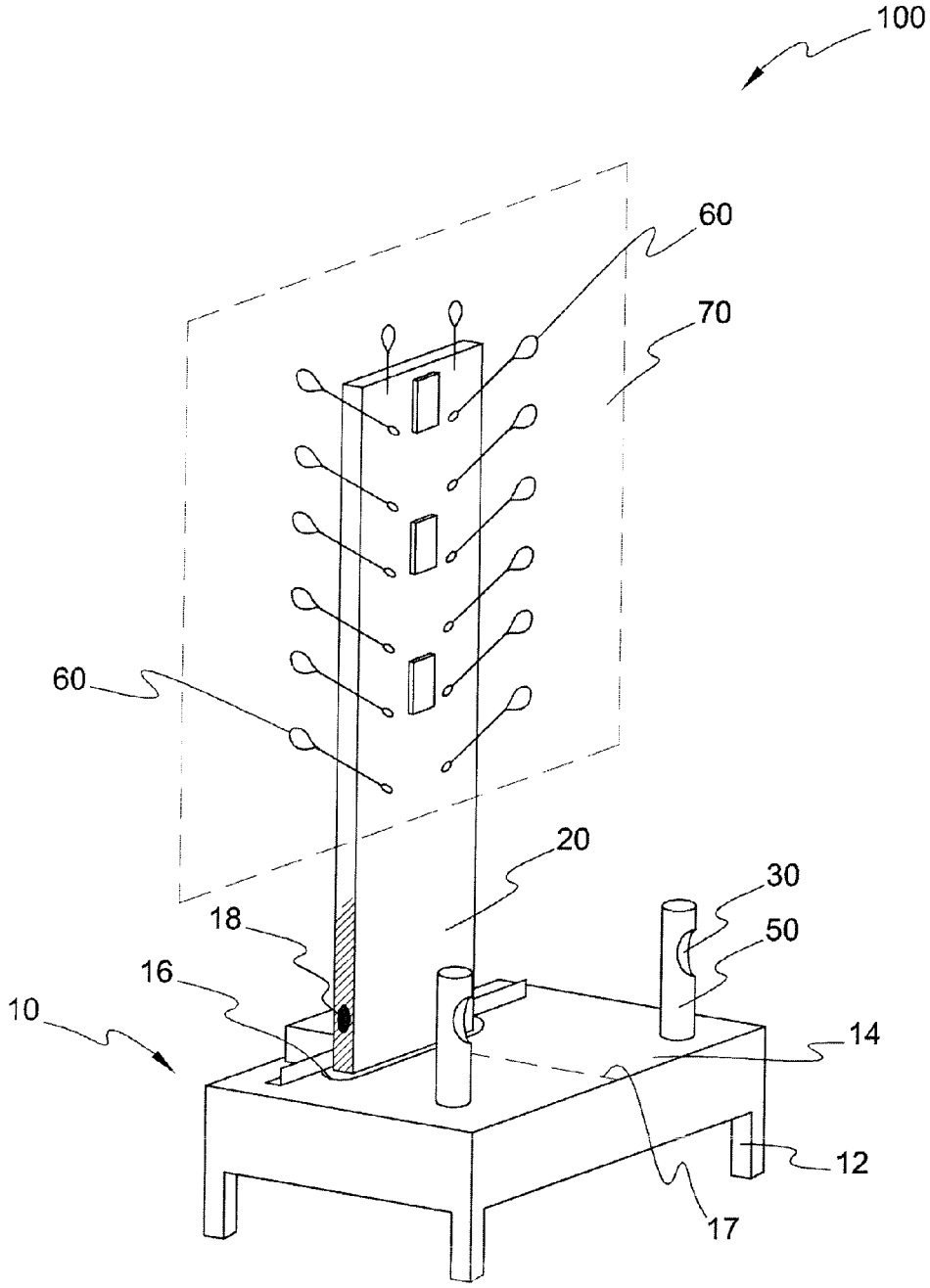
FIG. 1 is a perspective view of the target training apparatus mounted with a transparent target.

Referring to FIG. 1, a target training apparatus 100 is shown and described. In a preferred embodiment, the apparatus 100 comprises a substantially rectangular base 10 having a top surface 14 and bottom surface (not shown), wherein the bottom surface comprises leg 12 extrusions disposed at the corners of the substantially rectangular base 10. The base 10 further comprises a mounting collar 16 disposed on the top surface 14 center line 17 for mounting the target column 20, wherein the target column 20 is made of steel, or other hard material, on which deactivation wands 60 are attached. The mounting collar 16 receives the target column 20 in a vertically upright position to lock in place or to be adjusted in height and angular pitch using pins 18. The target column 20 is attached with a plurality of deactivation wands 60 disposed behind a target sign 70 (shown in dashed line) used in marksmanship training. In a preferred embodiment of the base 10, a cover is utilized to enclose the apparatus when disassembled, wherein the cover attaches over the base 10 with carrying handles, facilitating transportation.

Still referring to FIG. 1, the deactivation wands 60 would be disposed in particular locations corresponding to vital points of contact on the target sign 70. For example, target wands 60 would be disposed in places corresponding to vital organs of the person depicted on the target sign 70. In a preferred embodiment, the deactivation wands would be moveable to correspond with changing positions of the target. For example, if the person depicted in the target is crouched down, the deactivation wands 60 would be adjusted to correspond with the changed position of the vital organs. The target sign would be made of paper, cardboard, or other material penetrable by a paintgun pellet.

Still referring to FIG. 1 of the preferred embodiment, the top surface 14 of the base 10 supports a pair of firing columns 50 disposed in an upright position for housing a pair of paintball guns, wherein the firing column 50 comprises firing ports 30 disposed on the surface of the firing column 50 facing a trainee (shown in FIG. 4), wherein various settings of the firing columns 50 adjust the line of fire from two feet to twenty five feet.

Figure 2:
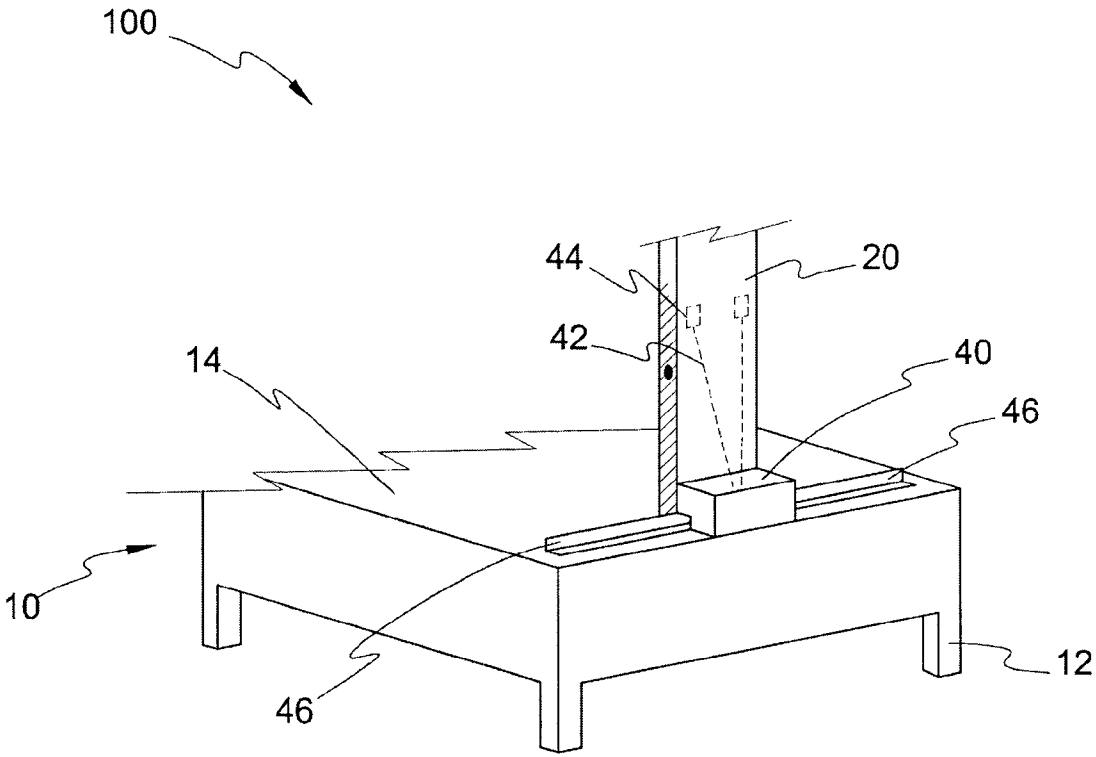
FIG. 2 is a rear perspective view of the base.
Figure 3:
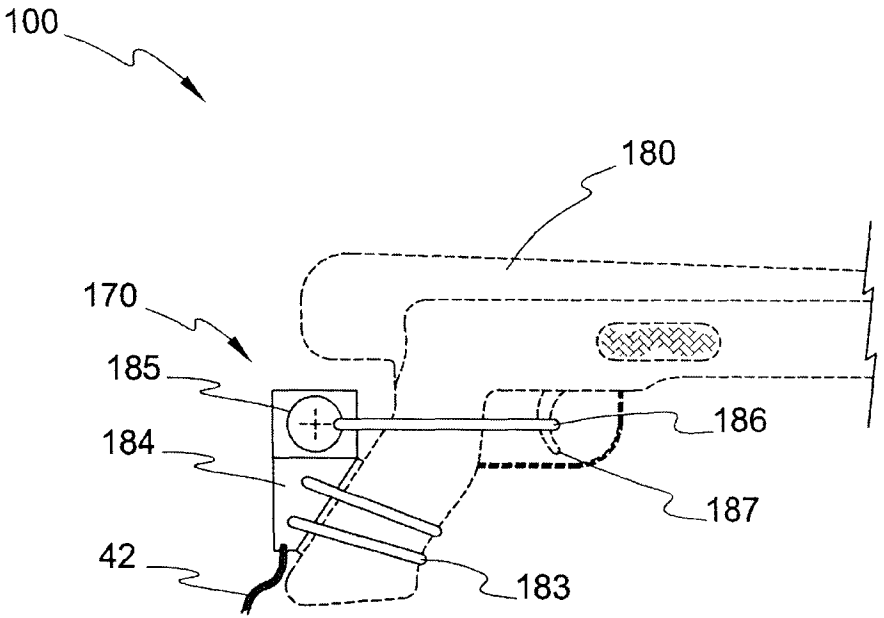
FIG. 3 is a side view of the trigger mechanism attached to a paintball gun.

Now referring to FIG. 2 of the present invention, the apparatus 100 comprises a utility box 40 disposed on the top surface 14 of the base 10, wherein the utility box 40 houses paintball gun utilities including compressed air bottles for propelling paintball pellets and a battery power pack for providing power to the electronic firing system (shown in FIG. 3). The utility box 40 further houses the electric cable 42 system of the power interrupt switches 44 attached to the target column 20. A piece of angle iron 46 disposed on the top surface 14 of the base 10 runs parallel along the rear of the base 10 to protect air hoses and electric cables 42 to the paintball guns from the utility box 40.

Referring to an alternate embodiment of the base 10, an angle iron member behaves as a holding means for the paintball gun barrel, wherein the angle iron is fastened with "U" bolts to the base 10.

FIG. 3 shows a preferred embodiment of the apparatus 100 comprising a gun activator 170, wherein the gun activator 170 comprises strapping means 183 to a paintball gun 180, wherein the paintball gun 180 comprises a trigger 187 engaged with a discharging lever 186. The discharging lever 186 is attached to a rotating wheel 185, wherein the cyclic rotations of the rotating wheel 185 force the discharging lever 186 against the trigger 187 causing the paintball gun 180 to fire paintballs. A motor housing 184 contains an electric motor for spinning the rotating wheel, wherein the electric motor is powered through the electric cable 42 attached to the motor housing 184.

Figure 4:
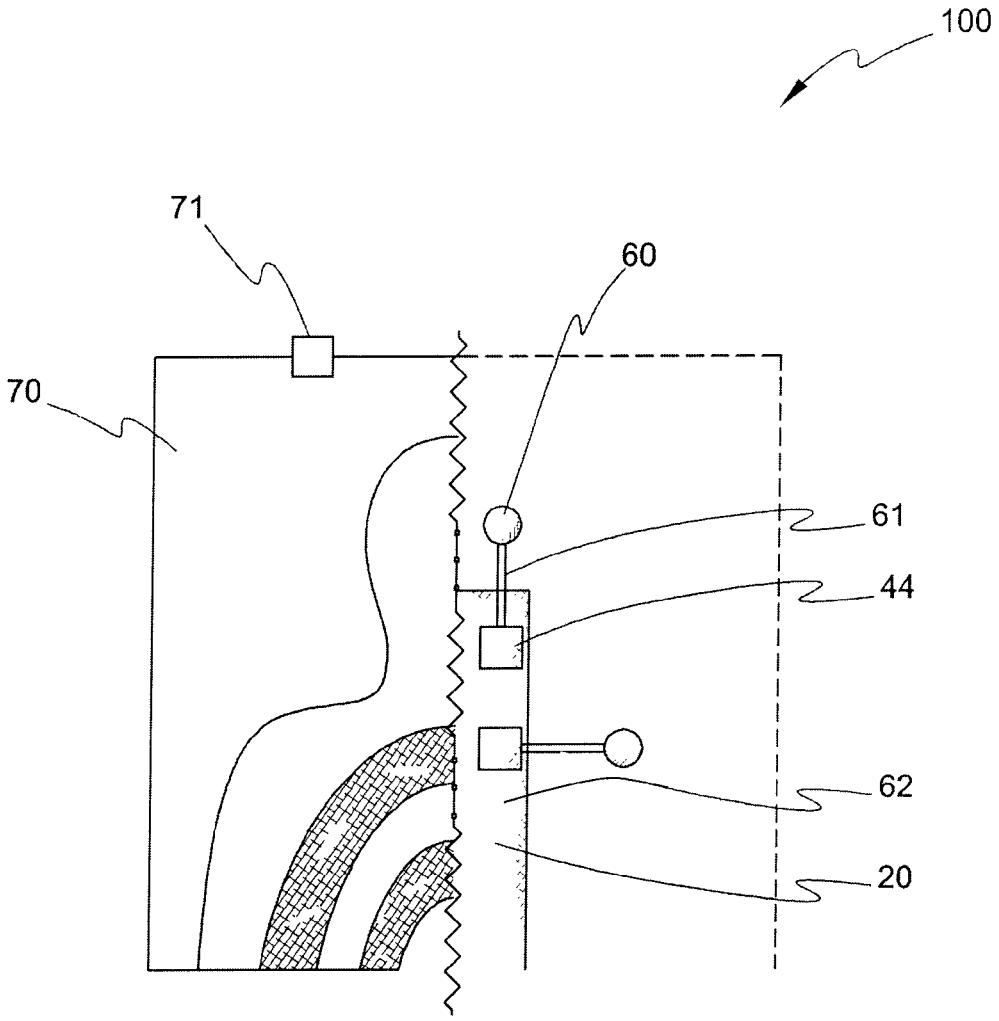
FIG. 4 is a front cut away view of the target sign showing the target column.

FIG. 4 of the apparatus 100, shows the target sign 70 suspended by at least one target holders 71, wherein the at least one target holder 71 is positioned with the target column 20 such that the deactivation wands 60 reference areas of accurate marksmanship on the target sign 70. In the preferred embodiment of the apparatus 100, the target column 20 comprises a pair of target holders 71 disposed on the target column such that the target sign 70 rests in substantially horizontal position. When at least one deactivation wand 60 is struck with a trainee's fired bullet or pellet, the power interrupt switch 44 is engaged by a rod 61, wherein the rod 61 is held in, moveable and mounted, with a pivoting axis 61 to the target column 20. The rod 61 cuts the electric power supply to the paintball guns. In the preferred embodiment of the apparatus 100, the deactivation wand 60, rod 61, and target column 20 are made of durable metal plates, such as steel, to withstand gun fire from a trainee.

Figure 5:
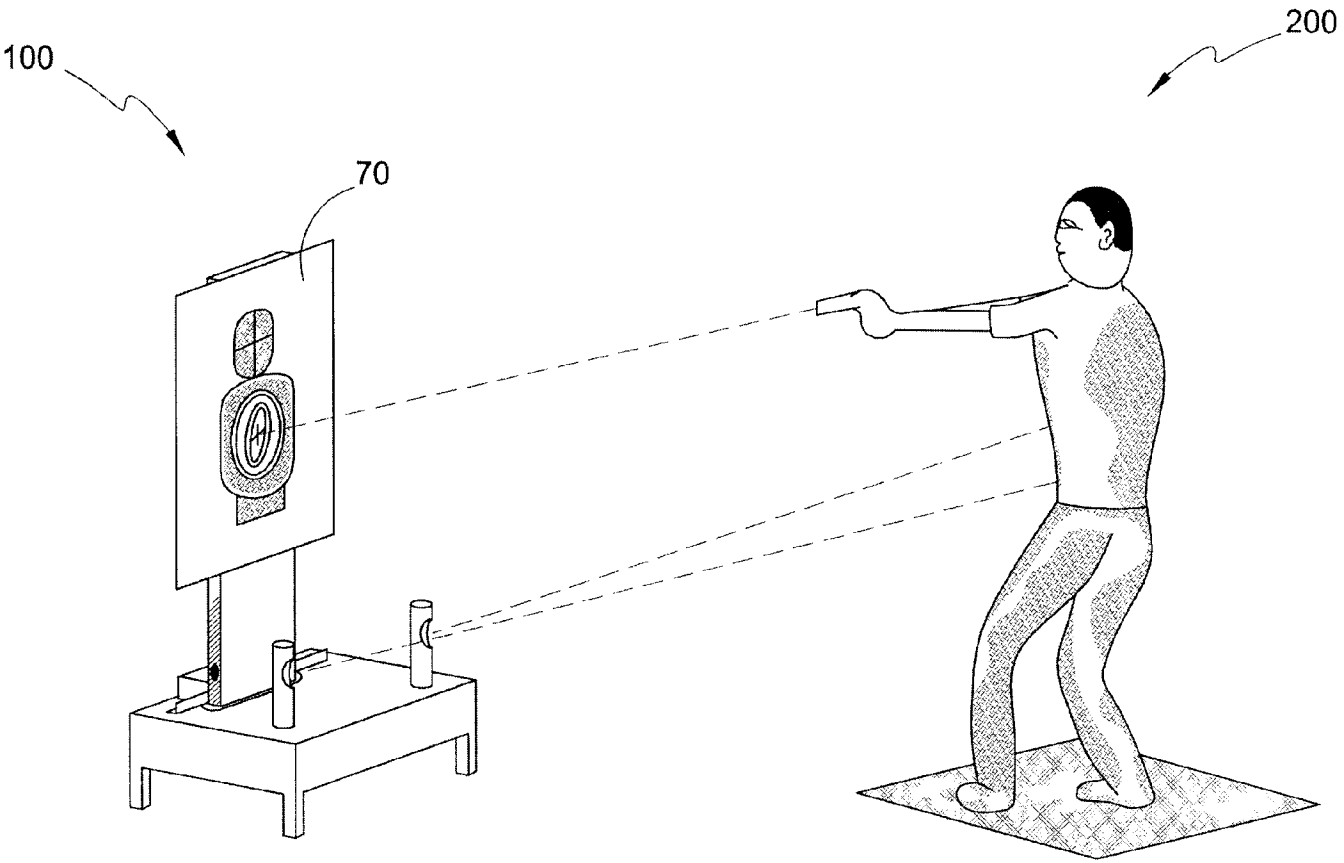
FIG. 5 is a perspective view of a combat situation involving a trainee and the apparatus of the present invention.

FIG. 5 shows a trainee 200 firing a weapon at the apparatus 100 from a distal location in front of the apparatus 100. The apparatus 100 continues to fire rounds of paintballs in the trainee's direction until the trainee successfully strikes a location on the target sign 70 which will cease the apparatus 100 from shooting at the trainee 200. [How do firing ports know the location of the trainee? If this is not part of the claimed invention due to McAlpin, or because it is known in the art, then no need to explain.]

All features disclosed in this specification, including any accompanying claims, abstract, and drawings, may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. §112, paragraph 6. In particular, the use of "step of" in the claims herein is not intended to invoke the provisions of 35 U.S.C. §112, paragraph 6.

Although preferred embodiments of the present invention have been shown and described, various modifications and substitutions may be made thereto without departing from the spirit and scope of the invention. Accordingly, it is to be understood that the present invention has been described by way of illustration and not limitation.

What is claimed is:

1. A targeting apparatus comprising:

a. a target column supported on a base, wherein the base comprises at least one firing column and housing for at least one weapons component, including paintball gun utilities, for firing at a trainee;

b. the target column comprises multiple deactivation wands aligned only with key locations on a target sign representing vital points of contact, wherein the target sign is held stationary by at least one target holder, the deactivation wands consists of a slender rod with one end pivotally attached to the target column and the other end having a head with a surface area wider than the rod and sufficiently wide to be struck by a conventional bullet;

c. an electronic cable system connecting the at least one deactivation wand with the at least one firing column, wherein the at least one firing column is connected to the at least one weapons component, and wherein the electric cable system deactivates the at least one weapons component only when at least one deactivation wand is struck on the surface of the head of the deactivation wand by a projectile.

2. The apparatus of claim 1, wherein the base comprises leg extrusions for support.

3. The apparatus of claim 1, wherein the target column comprises at least one target holder for fixing the target signs in place.

4. The apparatus of claim 1, wherein the base comprises a utility housing to store weapon components.

5. The apparatus of claim 1, wherein the firing column is connected to a second weapons component, including a paintball gun, attached with an electronic triggering device of which engages and disengages the second weapons component by its trigger.

6. The apparatus of claim 1, wherein the target column is adjustable in height and angular pitch using pins.

7. The apparatus of claim 1, wherein the at least one deactivation wand requires multiple strikes to cease fire at a trainee.

8. The appartus of claim 1, wherein the target column comprises power interrupt switches engaged by the striking on the surface of the at least one deactivation wand.

9. The apparatus of claim 1, wherein the electronic cable system is controlled by a remote control device, wherein the remote control device includes the feature to activate/deactivate the weapons components.

10. The apparatus of claim 1, wherein paintball gun utilities include compressed air bottles for propelling paintball pellets and a battery power pack for providing power to the electronic cable system.

* * * * *